US008905121B2

(12) United States Patent
Watson

(10) Patent No.: US 8,905,121 B2
(45) Date of Patent: Dec. 9, 2014

(54) LANCE FOR CLEANING THE SHELL SIDE OF A HEAT EXCHANGER CORE

(75) Inventor: Michael Watson, Rayleigh Essex (GB)

(73) Assignee: Tube Tech International Limited (GB)

( * ) Notice: Subject to any disclaimer, the term of this patent is extended or adjusted under 35 U.S.C. 154(b) by 374 days.

(21) Appl. No.: 13/232,242

(22) Filed: Sep. 14, 2011

(65) Prior Publication Data

US 2012/0000626 A1 Jan. 5, 2012

Related U.S. Application Data

(63) Continuation of application No. PCT/IB2010/051129, filed on Mar. 16, 2010.

(30) Foreign Application Priority Data

Mar. 16, 2009 (GB) ..... 0904481.9
Mar. 16, 2009 (GB) ..... 0904483.5

(51) Int. Cl.

| | |
|---|---|
| ***F28G 3/16*** | (2006.01) |
| ***F28G 1/16*** | (2006.01) |
| ***B05B 3/02*** | (2006.01) |
| ***B08B 9/023*** | (2006.01) |

(52) U.S. Cl.

CPC ..... *F28G 1/166* (2013.01); *F28G 3/166* (2013.01)

USPC ..... 165/95; 239/263.1; 239/525; 239/532; 134/167 R; 134/172; 134/198

(58) Field of Classification Search

CPC ..... F28G 1/166; F28G 1/16; B05B 3/02; B08B 9/023

USPC ..... 239/154, 225.1, 251, 261, 263.1, 264, 239/271, 288, 288.3, 525, 532, 548, 239/DIG. 13; 165/95; 122/379, 382, 390, 122/392; 376/316; 134/166 C, 167 R, 167 C, 134/172, 179, 198

See application file for complete search history.

(56) References Cited

U.S. PATENT DOCUMENTS

| | | | | | |
|---|---|---|---|---|---|
| 4,079,701 | A | * | 3/1978 | Hickman et al. | 122/382 |
| 4,600,153 | A | | 7/1986 | Stone | |
| 4,844,021 | A | * | 7/1989 | Stoss | 122/392 |
| 4,980,120 | A | | 12/1990 | Bowman | |
| 5,036,871 | A | * | 8/1991 | Ruggieri et al. | 134/167 R |

FOREIGN PATENT DOCUMENTS

| | | |
|---|---|---|
| DE | 908401 | 4/1954 |
| DE | 3305589 | 8/1984 |

OTHER PUBLICATIONS

Patent Cooperation Treaty; International Search Report issued Aug. 13, 2010 in PCT/IB2010/051129 by Officer Bruno Vassoille of the European Patent Office; 12 pages.

* cited by examiner

*Primary Examiner* — Darren W Gorman
(74) *Attorney, Agent, or Firm* — Mayback & Hoffman, P.A.; Gregory L. Mayback

(57) ABSTRACT

A handheld lance for high pressure jetting of tubes of a heat exchanger core comprises a fluid conduit defining an internal plenum chamber having at least one nozzle for emitting a jet of fluid for cleaning the outer surfaces of the tubes of the core and a coupling for connecting the plenum chamber to a high pressure fluid supply line. The or each conduit has an outer diameter sufficiently small to fit between all the tubes of the core and at least one elongate stabilizer bar is mounted on the coupling and positioned to one side of the or each conduit with the axis of the bar lying in the same plane as the adjacent conduit. The bar is sufficiently thin to fit between the tubes of the heat exchanger core and is sufficiently rigid to prevent lateral displacement of the adjacent conduit.

13 Claims, 3 Drawing Sheets

LANCE FOR CLEANING THE SHELL SIDE OF A HEAT EXCHANGER CORE

CROSS-REFERENCE TO RELATED APPLICATIONS

This is a continuing application, under 35 U.S.C. §120, of copending international application No. PCT/IB2010/051129, filed Mar. 16, 2010, which designated the United States and was published in English; this application also claims the priority, under 35 U.S.C. §119, of United Kingdom Patent Application Nos. 0904481.9 and 0904483.5, both filed Mar. 16, 2009. These prior applications are herewith incorporated by reference in their entirety.

STATEMENT REGARDING FEDERALLY SPONSORED RESEARCH OR DEVELOPMENT

Not Applicable

FIELD OF THE INVENTION

The present invention relates to a lance for cleaning the shell side of a heat exchanger core.

BACKGROUND OF THE INVENTION

FIGS. 1 to 3 of the accompanying drawings show the design of known heat exchangers. FIG. 1 is a vertical cross section through the heat exchanger while FIGS. 2 and 3 show alternative tube face cross sections taken in the plane II-II in FIG. 1. The heat exchanger comprises a shell 10 and a core 12. The core has two end plates 14, 16 which define headers 18, 20 at the top and the bottom of the shell 10. A set of tubes 22 is welded or expanded or both in holes in the two end plates 14, 16 to define fluid flow passages between the two headers and baffle plates 24, 26 support the tubes 22 along their length and maintain the spacing between them.

The tubes 22 can be disposed in a square pitch array, as shown in FIG. 2, with a typical spacing of 10 mm or less or in a triangular pitch array, or as shown in FIG. 3, with a typical spacing of 10 mm or less, the latter allowing a greater concentration of tubes.

In use, a first fluid is pumped via inlets and outlets and 30 to flow through the tubes 22 and a second fluid is pumped via connectors 32 and 34 to flow through the shell 10. The tubes are made of a good thermal conductor, so that a transfer of heat takes place between the two fluids during their passage through the heat exchanger.

Prolonged flow of fluids through the shell and the tubes can result in the formation of deposits and a reduction in the efficiency of the heat exchanger. It is, therefore, essential at intervals to clean the heat exchangers to remove such deposits.

The present invention is concerned only with the cleaning of a shell side of the tubes 22. To do this in the prior art, the entire core needs to be separated from the shell so that access can be gained to the external, i.e., shell side, surfaces of the tubes 22.

The conventional way of cleaning the shell side of the core is to use high pressure jetting. Narrow jets of fluid emitted from the front end of a handheld lance are aimed at the outermost surfaces of the tube nest to be cleaned to dislodge deposits adhering to the outer surfaces of the tubes. The fluid is usually water at between 1000 psi and 40,000 psi, but for certain applications it may be preferred to use other liquids or gases as the cleaning medium.

Such a lance is referred to herein as a handheld lance, to distinguish it from known lances, such as that shown in European Patent Application EP 0307961, that are mechanically fed in through a hole in the shell wall and are used to clean the header and the baffle plates. A handheld lance is one that is capable of being handheld and moved along the length of the core tubes by an operator. The term "handheld" is not intended to preclude the possibility of such a lance being mounted on a mechanical arm to permit automation of the cleaning process.

Conventional handheld lances include a conduit about 10 mm in outer diameter with a jet nozzle at its tip. Because of its large outer diameter, when cleaning a core of the type shown in FIG. 3, a conventional lance cannot be inserted between the tubes of the core and the high pressure jetting is carried out with the nozzle outside the core in the hope that the water will penetrate between the tubes and remove the deposit from scaled tubes. In the case of the core of FIG. 2, a lance can be inserted into the two wider slots provided for this purpose and the lance may be provided with lateral nozzles but the lance cannot be inserted between all the tubes of the heat exchanger.

The effectiveness of a high pressure fluid jet decreases as the distance from the nozzle to the surface being cleaning increases. For this reason, when using a large diameter lance, only the visibly accessible outer tubes near to the outside of the core can be cleaned efficiently.

It is, therefore, desirable to form a lance of tubing having a smaller outer diameter to be capable of being manually inserted between all the tubes of a heat exchanger. However, a long lance of narrow diameter would be incapable of withstanding the reaction force of a high power jet and would tend to buckle. It would be unsafe to use such a lance because the high power water jet, if uncontrolled, is capable of causing serious injury to the operator.

PRIOR ART

U.S. Pat. No. 4,980,120 to Bowman et al. discloses a sludge lance having an adjustable articulated portion permitting easy insertion of the lance between the tubes within a tube bundle in a steam generator. The lance includes a manipulator member whose outer end is attached to a plurality of radius blocks arranged in an abutting relationship. The radius blocks are movable through the actuation of a cam assembly causing the radius blocks to form an arc having an adjustable radius of curvature.

U.S. Pat. No. 4,600,153 to Stone discloses a cleaning tool for a refrigeration system comprising a flat elongate generally rectangular wand connectable to a pressurized fluid source and forming a plurality of fluidic cleansing jets. The wand has a fluid inlet end and a closed end with a plurality of jet ports formed in an adjacent side wall and is constructed and arranged for fluidic discharge in a predetermined pattern.

Other jetting configurations are known from German Patent DE 908401 C and German Patent DE 3305589 C2 to Conrad et al., for example, which provide jets in a U-shaped conduit or in two cross-braced conduits.

The present invention seeks to provide a handheld lance that is sufficiently narrow to fit between all the tubes of a heat exchanger to reach the center of the core yet does not bend nor buckle under the reaction force of the high pressure water jet.

SUMMARY TO THE INVENTION

According to the present invention, there is provided a handheld lance for high pressure jetting of tubes of a heat exchanger core, comprising a fluid conduit defining an internal plenum chamber having at least one nozzle for emitting a jet of fluid for cleaning the outer surfaces of the tubes of the core, and a coupling for connecting the plenum chamber to a high pressure fluid supply line. The or each conduit has an outer diameter sufficiently small to fit between all the tubes of the core, and at least one elongate stabilizer bar is mounted on the coupling and positioned to one side of the or each conduit with the axis of the bar lying in the same plane as the adjacent conduit, the bar being sufficiently thin to fit between the tubes of the heat exchanger core and sufficiently rigid to prevent lateral displacement of the adjacent conduit.

When a lance with an outer diameter sufficiently small to fit between all the tubes of the core is inserted between the vertical tubes of heat exchanger, its conduit cannot bend in a horizontal plane because it is prevented from doing so by collision with the tubes of the heat exchanger. However, it is capable of bending and buckling in a vertical plane and it is this bending that presents a safety hazard. The present invention recognizes that it is possible, by the use of an adjacent stabilizer bar, to stiffen the lance in the vertical plane without increasing its thickness and preventing it from being inserted between the vertical tubes of the core.

When using such a lance, a motor may be provided for rotating the or each conduit of the lance during use, such that each jet emitted from conduit traces a conical path. Apart from enabling scale to be removed from a larger area of the core, such rotation also has the effect of preventing buckling of the conduit in that the conduit will collide not only with the stabilizer bar of the lance but also with the tubes of the heat exchanger core.

When a conduit is rotating, it need only be steadied in one direction in each of two mutually inclined planes for it to be maintained straight and its axis in line with the axis of rotation at all times. It would, therefore, suffice to provide only one stabilizing bar for each rotating conduit, but, in an exemplary embodiment, provide two bars are provided disposed one on each side of the conduit. With two bars, bending and buckling of the conduit can be prevented regardless of whether or not the conduit is rotated.

Conduits are available inexpensively that have been tested to withstand high pressures. Welding or otherwise tampering with a conduit could affect its ability to withstand high pressure. For this reason, it is beneficial for the stabilizer bars not to be connected to the conduit but merely to rest alongside it.

To suit most applications, in an exemplary embodiment, the conduit has a thickness of no more than 6 mm and the thickness of any stabilizer bars do not exceed 6 mm.

The nozzles are separable from the conduit to permit their replacement when they are worn. The nozzles may be mounted to face any angle for example forwards, rearwards and laterally.

If laterally facing nozzles are provided, the nozzles are balanced so that no net reaction moment acts on the lance.

BRIEF DESCRIPTION OF THE DRAWINGS

The invention will now be described further, by way of example, with reference to the accompanying drawings, in which.

DETAILED DESCRIPTION OF THE INVENTION

Figure 1:
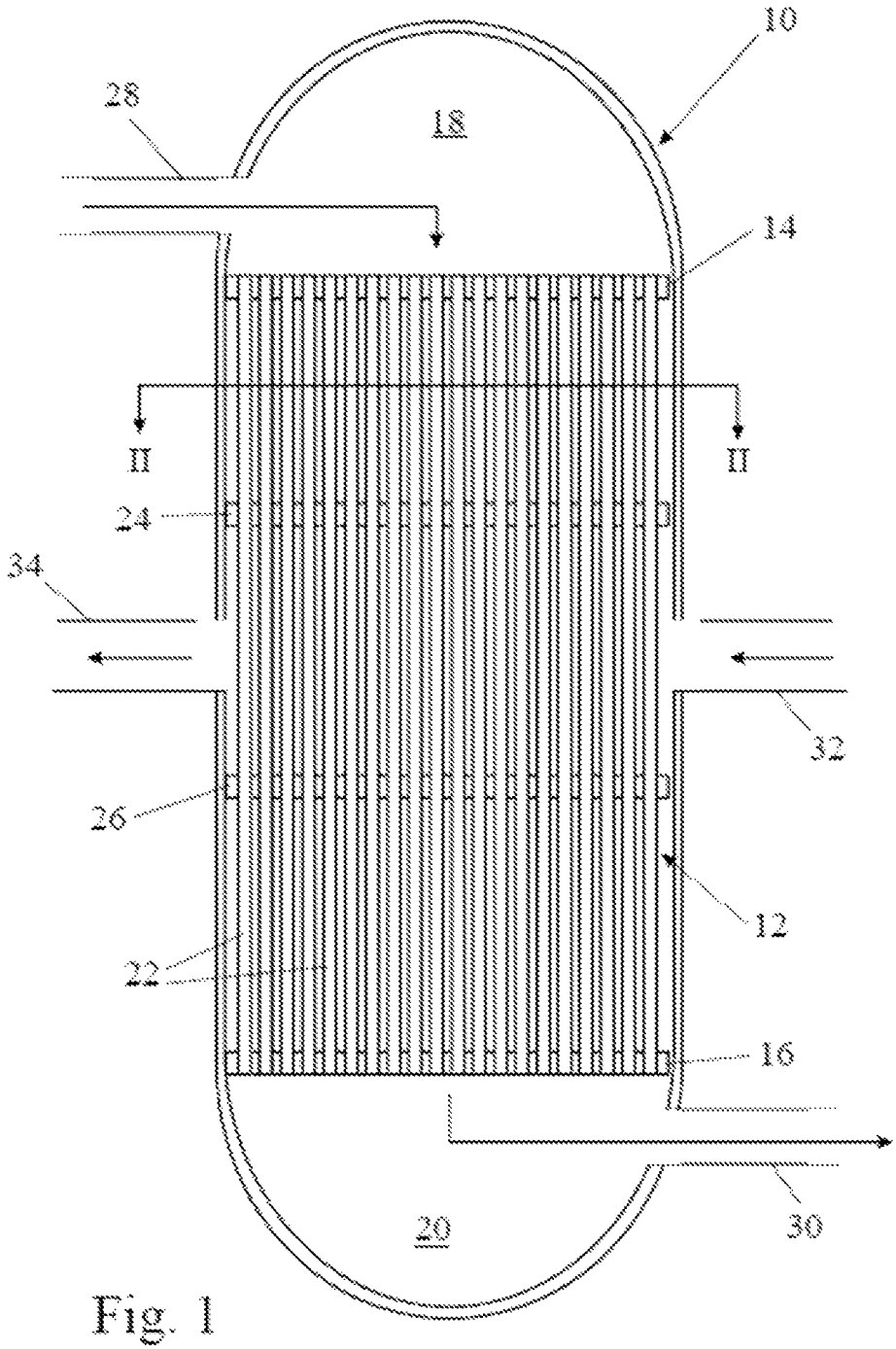
Fig. 1 PRIOR ART
FIG. 1 is a fragmentary, vertical cross-sectional view through a conventional heat exchanger.
Figure 2:
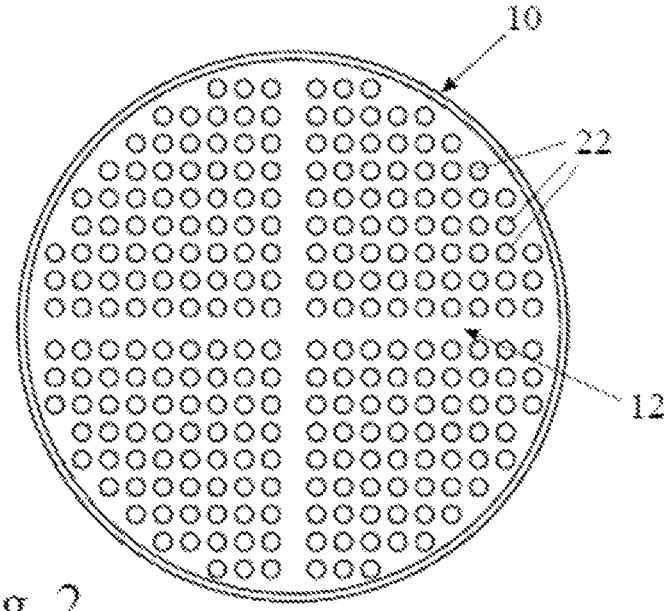
Fig. 2 PRIOR ART
FIG. 2 is a horizontal cross-sectional view taken through line II-II in FIG. 1 of another conventional heat exchanger with a different tube configuration.
Figure 3:
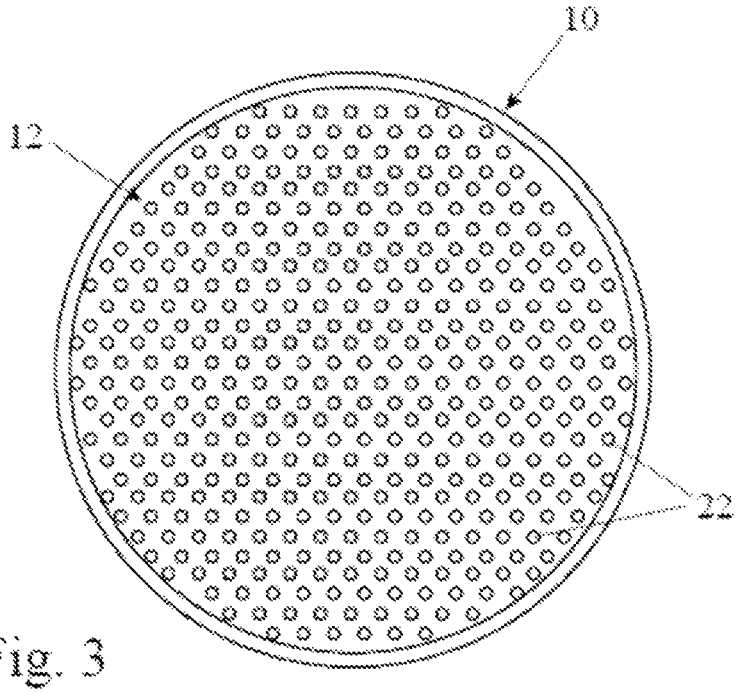
Fig. 3 PRIOR ART
FIG. 3 is a horizontal cross-sectional view taken through line II-II in FIG. 1 of still another conventional heat exchanger with a different tube configuration.
Figure 4:
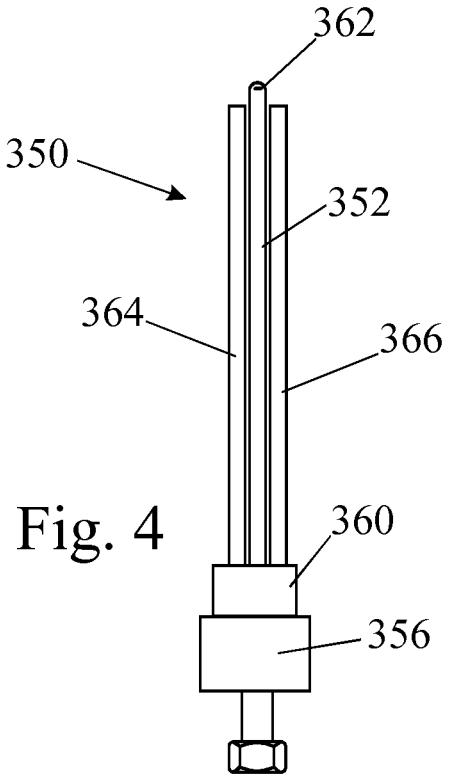
FIG. 4 is an elevational side view of a lance according to the invention.
Figure 5:
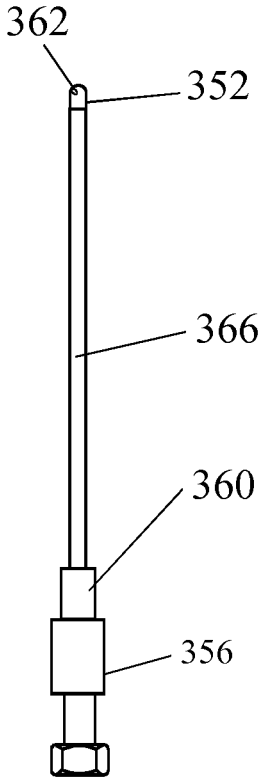
FIG. 5 is an elevational side view of the lance of FIG. 4 rotated ninety degrees.

The handheld lance 350 in FIGS. 4 and 5 comprises a tubular conduit 352 having an outer diameter of no more than 6 mm, connected to a coupling 356 which enables the conduit 352 to be connected to a conventional high pressure supply line. To prevent the thin conduit 352 from buckling, it is straddled by two stabilizing bars 364, 366.

The supply line, which is not shown, has a valve that allows the operator to turn the high pressure water supply on and off. The cleaning medium will herein be taken to be water though, as earlier mentioned, other liquids and gases may be more suitable in some situations.

Conventional nozzles, represented by small holes 362, are fitted to the tip of the conduit 352. The nozzles can wear out on account of grit in the water supply and, for this reason, it is beneficial if the nozzles are replaceable. The nozzles need not be described in detail as they may be the same as those fitted to large diameter lances.

Figure 6:
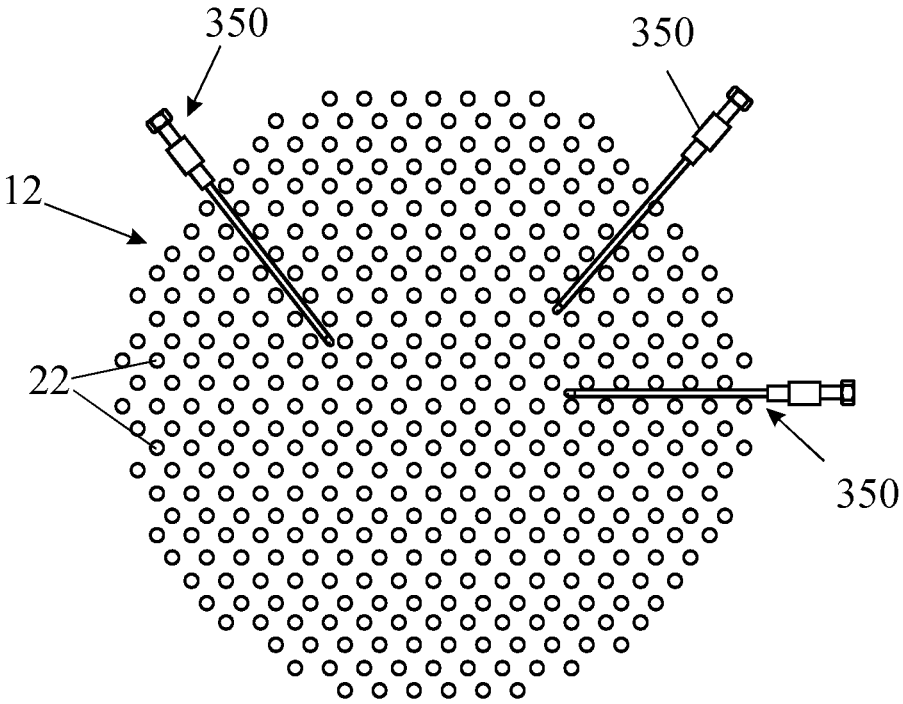
FIG. 6 is a fragmentary, cross-sectional view through a core of the heat exchanger of FIG. 3 and after its removal from its shell, showing the manner in which a lance according to the invention may be inserted between the tubes.

It is not uncommon for deposits to occupy nearly the entire space between the tubes 22 of the core and, before the handheld lance 350 can be inserted in between the tubes of the core from the different directions shown in FIG. 6, it is necessary to clear a path for the lance.

It is possible to form a handheld lance with only forward facing nozzles for the purpose of clearing a path for the lance. However, this operation can be performed as effectively using a conventional large diameter lance.

Once a path has been cleared for the tip of the lance 350, one can use a lance with forward, rearward, and laterally facing nozzles. The forward nozzles continue to clear a path for the lance while the laterally and rearwardly facing nozzles penetrate effectively into regions that cannot be reached by a jet aimed from outside of the core. As a jet impacts a surface, it dislodges any deposit on the surface and the resulting debris is carried by the spray onto tube surfaces that are not in the line of sight of the jet. In this way, the entire interior of the core is cleaned thoroughly.

Though the lance 350 is shown in FIGS. 4 and 5 as having only one tubular conduit 352, it is alternatively possible for there to be more than one.

A motor 360 is provided for rotating the or each conduit 352 relative to the coupling 356. The motor 360 can be driven pneumatically or electrically. As a further possibility, the nozzles 362 may be angled to generate a reaction torque for rotating the conduit 352. Rotation of the conduit will result in each emitted jet tracing a conical path.

Because the conduit 352 is constrained by the stabilizing bars, it is cannot move laterally and is, therefore, effectively prevented from bending or buckling. Because of this, the conduit 352 may safely be made sufficiently thin to be introduced between the tubes 22 of the core.

The reaction force from a laterally facing jet will only force the lance 350 against an adjacent core tube or stabilizing bar 364, 366 and it is not, therefore, detrimental if the lateral jets are not balanced. It is, however, preferred for them to be balanced to avoid any net moment acting on the lance 350, in case the water should inadvertently be turned on before the lance 350 is inserted between the tubes 22 or left turned on as the lance 350 is withdrawn.

The stabilizer bars 364, 366 can have a rectangular cross-section to withstand bending in the plane that they share with each other and with the conduit 352. Because the bars 364, 366 are, themselves, supported laterally by the tubes of the core through which they are inserted, there is no serious hazard presented if they and the conduit 352 have some flexibility a direction normal to the plane of the drawing in FIG. 4.

The invention claimed is:

1. A handheld lance for high pressure jetting of tubes of a heat exchanger core, the tubes each having a longitudinal axis and together defining a heat exchanger axis and a transverse plane orthogonal to the heat exchanger axis, the lance comprising:

at least one fluid conduit defining an internal plenum chamber and having:

at least one nozzle shaped to emit a jet of fluid for cleaning outer, shell side surfaces of the tubes of the heat exchanger core; and an outer diameter no greater than 6 mm and sufficient to fit between all the tubes of the heat exchanger core and defining a longitudinal conduit axis;

a coupling for fluidically connecting the plenum chamber to a fluid supply line to supply fluid at a pressure of up to 40,000 PSI; and at least one elongate stabilizer bar mounted on the coupling and positioned to one side of the at least one conduit, the at least one elongate stabilizer bar:

having an outer diameter no greater than 6 mm;

having a longitudinal stabilizer axis lying in the same plane as the longitudinal conduit axis; and being sufficiently thin to fit between the tubes of the heat exchanger core and sufficiently rigid to prevent lateral displacement of the at least one conduit adjacent thereto;

the at least one fluid conduit and the at least one elongate stabilizer bar being:

sized to fit between each pair of the tubes of the heat exchanger core at various angles about the heat exchanger axis within the transverse plane, the tubes being spaced apart by no more than 10 mm; and shaped to fit in the hand of and be used solely by a human operator.

2. The handheld lance according to claim 1, wherein:

the at least one fluid conduit is a single fluid conduit having the longitudinal conduit axis; and the at least one elongate stabilizer bar is two stabilizer bars each having the longitudinal stabilizer axis and together defining a plane containing the longitudinal conduit axis.

3. The handheld lance according to claim 1, further comprising a motor connected at least to the at least one fluid conduit and operable to rotate the at least one fluid conduit during use.

4. The handheld lance according to claim 2, further comprising a motor connected at least to the single fluid conduit and operable to rotate the single fluid conduit during use.

5. The handheld lance according to claim 1, wherein the at least one fluid conduit is rotatably coupled to the coupling and further comprising a motor operable to rotate the at least one fluid conduit during use.

6. The handheld lance according to claim 1, wherein the at least one elongate stabilizer bar is two stabilizer bars disposed on opposing sides of the at least one conduit.

7. The handheld lance according to claim 1, wherein the at least one nozzle is separable from the at least one fluid conduit to permit replacement when the at least one nozzle is worn.

8. The handheld lance according to claim 1, wherein the at least one nozzle is a plurality of nozzles mounted at the at least one fluid conduit and facing at different angles from the longitudinal conduit axis.

9. The handheld lance according to claim 1, wherein the at least one nozzle is a plurality of nozzles mounted at the at least one fluid conduit and facing laterally.

10. The handheld lance according to claim 9, wherein the plurality of nozzles are balanced to have substantially no net reaction moment acting on the at least one conduit during use.

11. A handheld high-pressure lance for cleaning tubes of a heat exchanger core, the tubes defining a minimum separation distance of 6 mm therebetween, each having a longitudinal axis and together defining a heat exchanger axis and a transverse plane orthogonal to the heat exchanger axis, the lance comprising:

a fluid conduit:

defining a longitudinal conduit axis and an internal plenum chamber;

having at least one nozzle fluidically connected to the plenum chamber and shaped to emit a jet of fluid of up to 40,000 psi to clean outer, shell side surfaces of the tubes of the heat exchanger core; and having an outer diameter no greater than the 6 mm minimum separation distance of the tubes of the exchanger core;

a coupling shaped to fluidically connect the at least one nozzle to a high pressure fluid supply line through the plenum chamber; and at least one elongate stabilizer bar:

having an outer diameter no greater than 6 mm;

having a longitudinal stabilizing axis;

being sized to fit between each pair of the tubes in the heat exchanger core;

being mounted at and extending from the coupling alongside and parallel to the fluid conduit; and being operable to stabilize the fluid conduit in use substantially along a plane defined by the longitudinal conduit axis and the longitudinal stabilizing axis; and the fluid conduit and the at least one elongate stabilizer bar being:

sized to fit between each pair of the tubes of the heat exchanger core at various angles about the heat exchanger axis within the transverse plane; and shaped to fit in the hand of and be used solely by a human operator.

12. The handheld lance according to claim 11, wherein the at least one elongate stabilizer bar is sufficiently rigid to prevent lateral displacement of the adjacent fluid conduit.

13. The handheld lance according to claim 11, wherein the fluid conduit, the internal plenum chamber, and the at least one nozzle are operable to transfer the fluid therethrough at approximately 40,000 psi.

* * * * *